United States Patent [19]

Burke

[11] Patent Number: 4,540,038

[45] Date of Patent: Sep. 10, 1985

[54] METHOD FOR PRODUCTION OF COMBUSTION TURBINE BLADE HAVING A HYBRID STRUCTURE

[75] Inventor: Michael A. Burke, Pittsburgh, Pa.

[73] Assignee: Westinghouse Electric Corp., Pittsburgh, Pa.

[21] Appl. No.: 617,458

[22] Filed: Jun. 5, 1984

[51] Int. Cl.[3] ..... B22D 11/16

[52] U.S. Cl. ..... 164/499; 164/122.1

[58] Field of Search ..... 164/499, 147.1, 122.1, 164/122.2; 148/39

[56] References Cited

U.S. PATENT DOCUMENTS

| | | | |
|---|---|---|---|
| 3,669,180 | 6/1972 | Moore et al. | 164/122.1 |
| 3,790,303 | 2/1974 | Endres | 164/122.1 |
| 4,184,900 | 1/1980 | Erickson | 164/39 |
| 4,256,165 | 3/1981 | von Starck et al. | 164/504 |

*Primary Examiner*—Nicholas P. Godici
*Assistant Examiner*—Gerard M. Reid
*Attorney, Agent, or Firm*—R. A. Stoltz

[57] ABSTRACT

This is a process of fabricating directionally solidified turbine blades for combustion turbines. It is an improvement to the type of process where a mold containing molten metal is cooled in a controlled fashion such that solidification occurs slow enough to allow directional solidification beginning at the airfoil end. In the improved process solidification is monitored and magnetic mixing of the remaining molten metal is started at approximately the beginning of solidification of said root section and the rate of cooling of said blade is increased to a rate faster than at which directional solidification occurs. A blade is produced with a directionally solidified airfoil section and a fine grained root section and without a substantially inhomogeneous portion at the interface between the airfoil and root sections.

1 Claim, 6 Drawing Figures

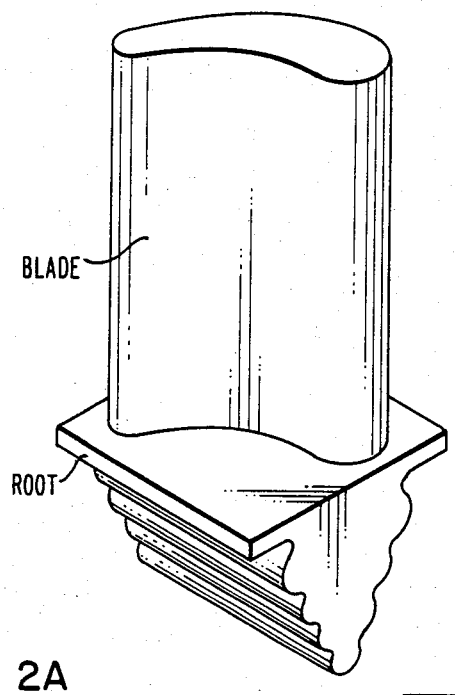
FIG. 1
FIG. 2A
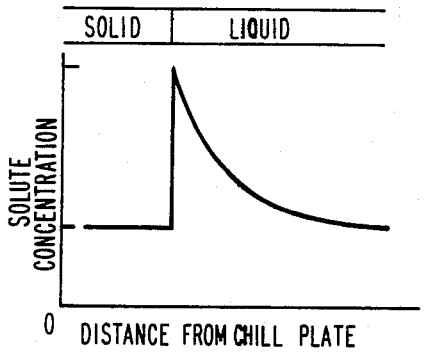
FIG. 2B
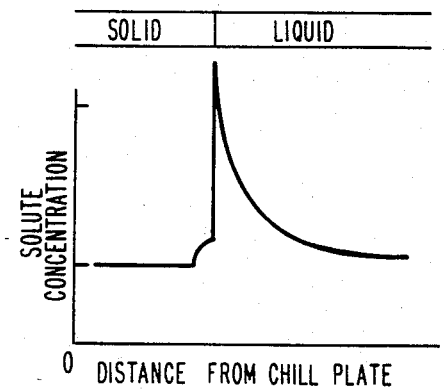
FIG. 2C
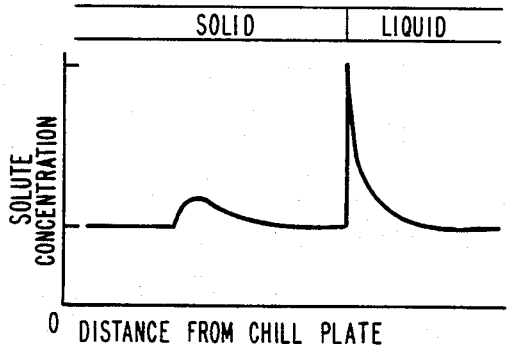

METHOD FOR PRODUCTION OF COMBUSTION TURBINE BLADE HAVING A HYBRID STRUCTURE

BACKGROUND OF THE INVENTION

This is a method for making turbine blades for combustion turbines, including aircraft turbines, marine turbines, and land-based gas turbines. This invention utilizes a two step solidification to produce a fine grained (non-directionally solidified) structure in the root section and a directionally solidified structure in the airfoil section.

Gas turbine engines operate by extracting energy from high temperature, high pressure gas as it expands through the turbine section. The actual rotating components which are driven by the gas are manufactured from nickel-based superalloys and are commonly known as blades. They consist, as shown in FIG. 1, of a contoured airfoil which is driven by the hot gas stream and of a machined root which connects to the turbine rotor. Due to the nature of the carnot cycle, gas turbines operate more efficiently at higher temperatures and there has thus become a demand for materials which are able to withstand higher temperatures. The major mechanical modes of failure for turbine blades, such as aircraft engines and in land-based turbine generators, at high temperatures have been thermal fatigue and the lack of creep rupture resistance. Both of these problems may be reduced by elimination of grain boundaries which are transverse to the major stress axis. Thus, single crystal and directionally solidified blades are known to display significantly improved high temperature strength.

While large grain sizes improve the desired properties in the very high temperature regime, at low temperatures certain mechanical properties are improved by lower grain size. Specifically, the root section of a turbine blade runs at considerably lower temperature than the airfoil and is, essentially, subjected to fatigue loading. Consequently, the optimum structure for airfoil and root sections of the blades are very different and, in conventional airfoils, some compromise must be accepted in one of these sections. The optimum properties would be obtained if a hybrid blade structure were produced with a directionally solidified airfoil and a fine grained root section.

In U.S. Pat. No. 4,184,900, issued Jan. 22, 1980 to Erickson et al., two different directionally solidified sections are produced to obtain different properties in the airfoil and root sections. In U.S. Pat. No. 3,790,303, issued Feb. 5, 1974 to Endres, a eutectic alloy is used to produce a hybrid turbine blade (bucket) having an airfoil which is directionally solidified and a non-oriented structure in the root, the eutectic composition avoiding composition inhomogenuities which would result if non-eutectic compositions were used in such a method.

SUMMARY OF THE INVENTION

This is a turbine blade having a hybrid grain construction and which can be fabricated using alloy compositions which are non-eutectic. The airfoil sections are directionally solidified while the root section has a fine grained non-directionally solidified structure.

The process utilizes solidification at a slow enough rate to allow directional solidification beginning at the airfoil end, with monitoring of the solidification. When the solidification reaches the interface between the airfoil and root sections, magnetic stirring is commenced to eliminate the inhomogeneous zone adjacent to the just-solidified portion. Cooling is then increased to a rate faster than that at which directional solidification occurs. Thus, a blade is produced with a directionally solidified airfoil section and a fine grained root section, and without a substantially inhomogeneous portion at the interface between the airfoil and root sections.

BRIEF DESCRIPTION OF THE DRAWINGS

The invention can be best understood by reference to the following drawings in which:

FIG. 1 shows a typical turbine blade having airfoil and root sections;

FIGS. 2, 2B and 2C show a series of three graphs showing the solute rich band during solidification and the inhomogenuity resulting from an increase in solidification velocity.

DESCRIPTION OF THE PREFERRED EMBODIMENTS

The prior art technology for producing a directionally solidified airfoil with a fine grained root section was impractical for non-eutectic alloys, as a serious compositional inhomogenuity was produced at the interface between the airfoil and the root. As shown in FIG. 2, if a blade with a directionally solidified airfoil and a fine grained root were produced, with the blade section under conditions conducive to directional solidification (low growth rate, high thermal gradient) and then the root section with an increased growth rate for solidification of the root section, it is found that at the region which was solidifying when the rate change was affected, there is a significant increase in solute content (the left-hand bump on the curve of FIG. 2C). Most nickel-based superalloys which are commonly used for gas turbine blading are non-eutectic. On such blades, this inhomogenuity would produce a region of significantly inferior mechanical properties. It should be noted that the compositional inhomogenuity zone will still exist even if the root section were to be solidified first.

To avoid the problem of a compositional inhomogenuity zone in the region where a directionally solidified airfoil is joined with a fine grained root structure, the present invention utilizes magnetic stirring to eliminate such a zone. The magnetic stirring mixes the solute rich band in the relatively massive, still molten root section, thus avoiding any significant change of composition.

Magnetic stirring is based on the principle that an electrical conductor lying in a magnetic field experiences a force normal to the plane that contains the current vector and the magnetic field vector. If the conductor is a liquid, the force causes shearing and a stirring effect is produced. Magnetic stirring has been used, for example, in continuous casting as noted in U.S. Pat. No. 4,256,165, issued Mar. 17, 1981 to Axel von Starck et al.

This invention utilizes magnetic stirring to redistribute the solute enrichment which occurred ahead of the solidifying directionally solidified airfoil to prevent inhomogenuity when the cooling rate is increased to produce the fine grained structure required in the root.

Figure 3B:
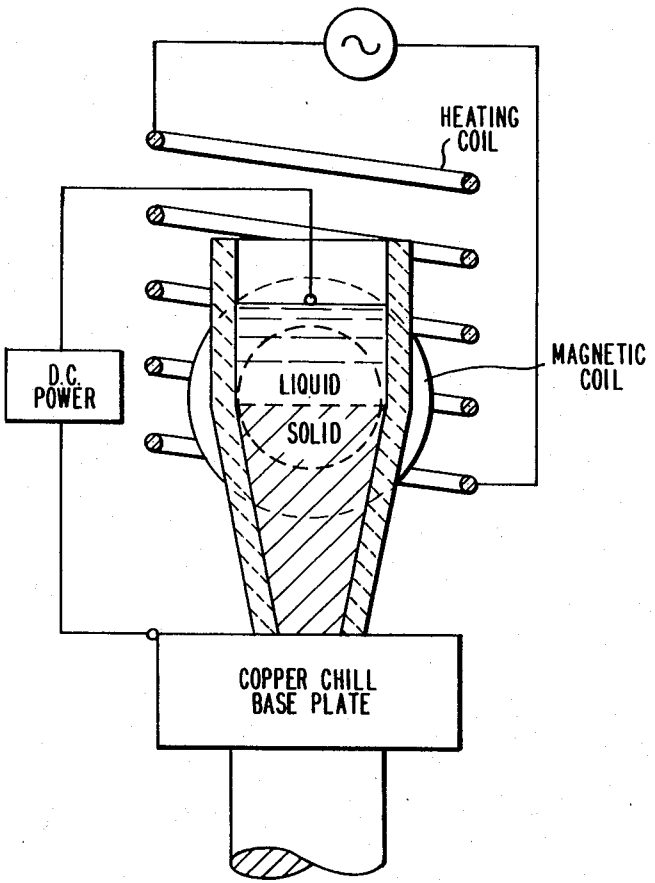
FIGS. 3A and 3B show directional solidification by controlled withdrawal from a furnace.
Figure 3A:
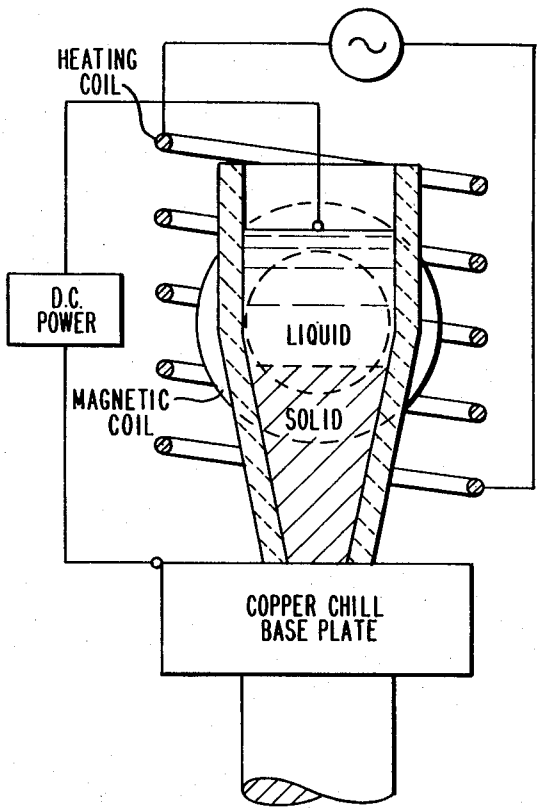

Directional solidification can be accomplished, for example, as shown in FIG. 3 where solidification proceeds from a copper chill base plate and controlled solidification is produced by slowly removing the base plate and the mold from the hot zone of the furnace. Here the root section is towards the top and the airfoil is removed from the furnace first. More rapid solidification may be affected by increasing the rate of removal. In order to produce a homogenous fine grain structure in the root of the blades, the magnetic stirring should be started essentially simultaneously with the increase in growth rate. Thus, solidification begins with the airfoil where growth occurs under relatively slow removal and the only stirring of the liquid is by natural convection. As the mold is withdrawn, the solidification front reaches the airfoil-root interface. At this point, the withdrawal rate is increased to above that at which directional solidification occurs and the magnetic stirring is begun (simultaneously or just prior to the increase in withdrawal rate). The magnetic stirring is begun by activating the system to pass electric current through the liquid and also through the magnetic coils (to produce the required magnetic field). In this case the more rapid solidification which produces a finer, more equiaxed, grain structure occurs due to the more rapid removal and the stirring is by the forced magnetic stirring, rather than by natural convection. In this way, the solute buildup ahead of the advancing interface is dispersed into the liquid and a more chemically homogenous structure is produced.

In this way, turbine blades can be produced which have directionally solidified (as used herein the term directionally solidified includes single crystal) structures in the airfoil, but fine grained structures in the root section utilizing practical, non-eutectic alloys, without creating a band of solute rich composition where the solidification rate was increased (at the root-airfoil interface).

The particular configuration and method of controlling the cooling rate and also the configuration for producing magnetic stirring, are, of course, examples, and other directional solidification and magnetic stirring methods can be used. Thus, the invention is not to be construed as limited to the particular forms described herein, since these are to be regarded as illustrative rather than restrictive. The invention is intended to cover all processes which do not depart from the spirit and scope of the invention.

I claim:

1. In a process of fabricating directionally solidified turbine blades for combustion turbines of the type wherein a mold containing molten metal is cooled in a controlled fashion such that solidification occurs slow enough to allow directional solidification beginning at the airfoil end, the improvement comprising:

monitoring said solidification and starting magnetic mixing of the remaining molten metal at approximately the beginning of solidification of said root section and then increasing the rate of cooling of said blade to a rate faster than at which directional solidification occurs, whereby a blade is produced with a directionally solidified airfoil section and a fine grained root section and without a substantially inhomogeneous portion at the interface between the airfoil and root sections.

* * * * *